US005439405A

United States Patent [19]

Storey et al.

[11] Patent Number: 5,439,405

[45] Date of Patent: Aug. 8, 1995

[54] COMBINED TOTE BAG, SEMI-SUBMERGIBLE FLOATING CHAIR/RECLINER AND BEACH CHAIR/PAD

[75] Inventors: Thomas C. Storey, Tampa, Fla.; Maria I. Kahl, Scarborough, Canada

[73] Assignee: Aqua Buoyz, Inc., Tampa, Fla.

[21] Appl. No.: 98,412

[22] Filed: Jul. 26, 1993

Related U.S. Application Data

[63] Continuation-in-part of Ser. No. 13,685, Feb. 4, 1993, abandoned.

[51] Int. Cl.[6] ..... B63C 9/30

[52] U.S. Cl. ..... 441/127; 441/126

[58] Field of Search ..... 441/125–132, 441/35, 40; 5/462–466; 297/456, 250, 216, 217, 188; 224/155, 156

[56] References Cited

U.S. PATENT DOCUMENTS

| | | | |
|---|---|---|---|
| 2,350,679 | 6/1944 | Hann | 441/126 |
| 3,817,574 | 6/1974 | McNab | 297/188 |
| 3,860,976 | 1/1975 | Suyama | 4/185 B |
| 3,995,802 | 12/1976 | Johnston | 224/8 |
| 4,116,310 | 9/1978 | Shields | 190/42 |
| 4,144,607 | 3/1979 | Soubie | 9/339 |
| 4,157,134 | 6/1979 | Stoll | 190/1 |
| 4,190,018 | 2/1980 | Harvell | 5/465 |
| 4,275,473 | 6/1981 | Poirier | 9/13 |
| 4,361,356 | 11/1982 | Tunick | 297/129 |
| 4,375,111 | 3/1983 | Hall | 5/419 |
| 4,472,151 | 9/1984 | Hoffman | 441/127 |
| 4,674,631 | 6/1987 | Williams | 206/216 |
| 4,687,248 | 8/1987 | Ross et al. . | |
| 4,723,300 | 2/1988 | Aranow | 383/4 |
| 4,736,825 | 4/1988 | Belf | 190/8 |
| 4,822,309 | 4/1989 | Vandenberg | 441/35 |
| 4,843,662 | 7/1989 | Handelman | 5/481 |
| 4,854,637 | 8/1989 | McCree | 297/188 |
| 4,861,300 | 8/1989 | Cassagrande et al. | 441/81 |
| 4,863,003 | 9/1989 | Carter | 190/8 |
| 4,945,589 | 8/1990 | Carey | 5/442 |
| 4,984,906 | 1/1991 | Little | 383/4 |
| 5,004,134 | 4/1991 | Barry | 224/209 |
| 5,052,965 | 10/1991 | Klapp et al. | 441/130 |
| 5,087,095 | 2/1992 | McFate | 224/155 |
| 5,088,723 | 2/1992 | Simmons | 272/1 B |
| 5,209,381 | 5/1993 | Joy | 224/155 |

FOREIGN PATENT DOCUMENTS

| | | | |
|---|---|---|---|
| 2623574 | of 1950 | Germany | 155/47 |

*Primary Examiner*—Edwin L. Swinehart

*Attorney, Agent, or Firm*—Cushman, Darby & Cushman

[57] ABSTRACT

A combination tote bag, floating chair/recliner and beach chair/pad (10) comprised of buoyant cushioned sections, all of which are covered with material (53) and are fastened together with zippers in a number of different ways for a variety of purposes. A collapsible chair frame (58) is included and is configured by placing the tubular parts together, zipping the cushions together in a flat position and, by using the headrest pocket (42), secure the cushions onto the frame. Without the frame, the cushion configuration forms a beach mat or chair pad. The carrying case can be configured to carry a substantial number of articles or be configured to a smaller size by attaching two rectangular cushions to provide storage space for flat articles such as magazines or correspondence. The carrying case is reversible and is carried by hand straps, or a shoulder strap. It becomes a back pack by detaching the shoulder strap (20) from the carrying case and attaching it to the fasteners provided on the back section (13). By fastening the front section (12) to the middle section (17) and this to the back section (13), an individual can float comfortably with torso and lumbar support in a semi-submergible sitting position. By fastening the cushions together in a flat position, an individual can float in a reclining position with a cushioned headrest (40).

14 Claims, 4 Drawing Sheets

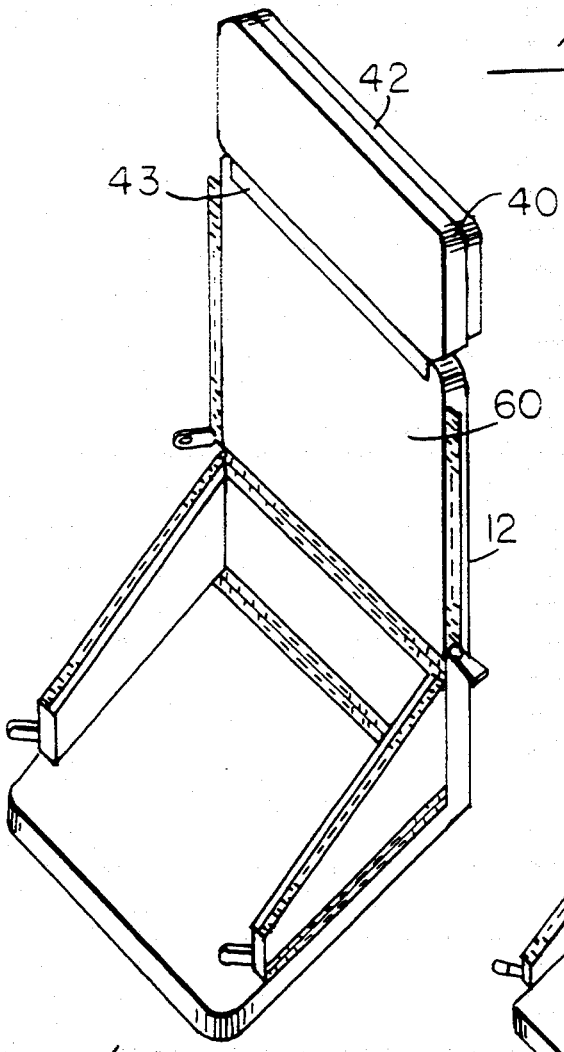
Fig. 11.
Fig. 12.
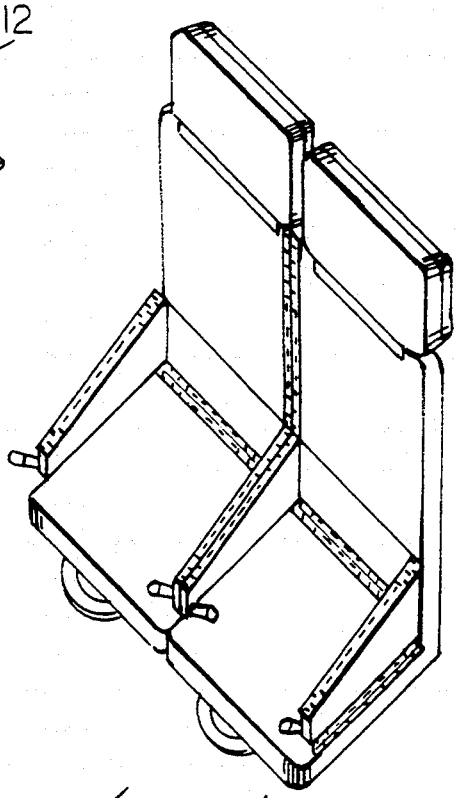
Fig. 13.
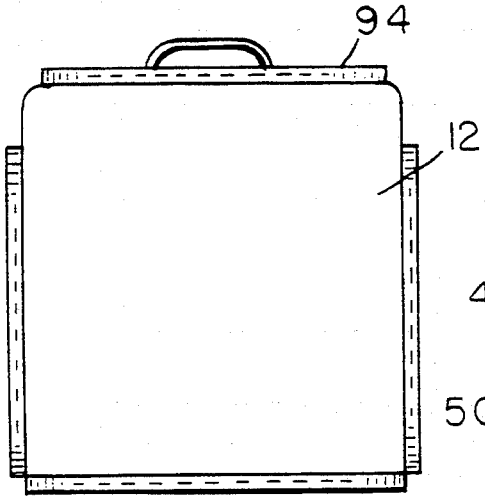
Fig. 10.
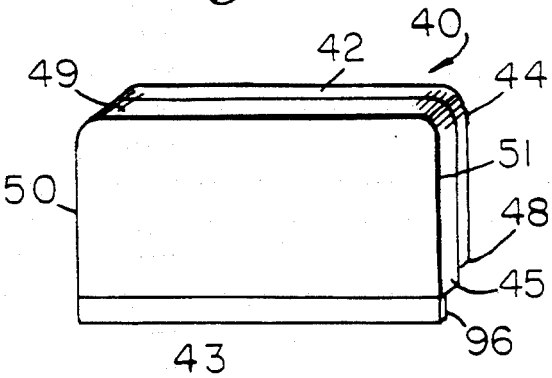

COMBINED TOTE BAG, SEMI-SUBMERGIBLE FLOATING CHAIR/RECLINER AND BEACH CHAIR/PAD

This application is a continuation-in-part of application Ser. No. 08/013,685 filed on Feb. 4, 1993 in the names of Thomas C. Storey and Maria I. Kahl, now abandoned.

BACKGROUND—FIELD OF INVENTION

This invention relates to a combined multi-functional tote bag, semi-submergible floating chair/recliner and collapsible beach chair/pad which has been designed to provide a quality product with as many uses as possible to the consumer at an economical price. More specifically, this invention relates to a combination multi-cushioned and zippered construction whereby the unit can be quickly and conveniently converted to a number of shapes and sizes for a variety of purposes, some of which have never been combined with a tote bag invention in prior art. The use of this invention, for some of its intended purposes, is not limited by weather conditions or outdoor activities; it can be used year round, at work or play.

BACKGROUND—DISCUSSION OF PRIOR ART

Multi-purpose tote bags combined with chairs, or with cushions have been known to the art, such as those disclosed by Ross, Friedman, Friedman, U.S. Pat. No. 4,687,248 and Harvell, U.S. Pat. No. 4,190,918 which were designed to provide comfort to the user but do not address the problem of providing a combined multi-purpose tote bag that meets all of the needs and functions described herein.

The prior art discloses a number of beach chairs, floating chairs, lounges, recliners, mats, submergible floatation devices, inflatable and non-inflatable floatation devices, and numerous combination tote bags with seats, tote bags with mats, and tote bags with chairs. However, no prior art combines as many functions as this invention.

Presently, there are a variety of activities wherein there are space constraints which limit the ability of an individual to conveniently transport the items necessary to engage in the activity to the site where such activities are taking place. For instance, during camping, picnicking, boating, beach activities, etc. Typically, an individual wants to take food, beverages, sun tan lotions, towels, a change of clothes, floatation devices, a cushioned pad, a beach chair, etc. None of the prior art has ever addressed the problem of providing there individuals with a completely multi-functional item which allows them to carry their various paraphernalia in an all-in-one, light-weight, tote bag that can be converted to a collapsible beach chair/pad, and a semi-submergible floating chair/recliner so that they can float and relax in the water and fully enjoy their outing.

The problem is further compounded when a mother takes a baby along because of the paraphernalia associated with the infant's needs. None of the prior art has solved the problem of providing a mother with a combined baby change pad with a wind shield and privacy shield when there is a need to change their infant's diapers in public areas, or providing mother with a beach chair frame/pad, floating chair/recliner on which to relax along with a method of carrying the tote in such a manner that she is hands free to hold her child.

In addition, none of the prior art has combined these features with a back pack device for carrying paraphernalia by utilizing a detachable shoulder strap that is threaded through loops affixed to the tote bag. This is an important function for mothers with small children, cyclists, and hikers alike.

U.S. Pat. No. 5,052,965 by Klapp and Klapp (1989) shows a floating recliner and states that it floats the user "atop the surface of any water body" as opposed to being partially submerged. This device also relies on the individual's ability to maintain their balance while sitting in an upright position. This is difficult because there are no side portions, that are affixed to the base portion to ensure stable support through the torso and lumbar areas. As soon as an individual leans against the back portion of this device, it automatically reclines them backwards. In addition, this device does not disclose any structure for using it as a carrying device, a beach chair or any of the other combinations cited herein.

Simmons, U.S. Pat. No. 5,088,723 is an inflatable submergible aquatic device. Inflatable devices are easily punctured and must be inflated to use and deflated before they can be transported. It also requires significant storage space and is cumbersome to transport from one location to another. Due to the complexity of this device, this item would not be economical. It is not a combined use invention.

Other recreational floating devices such as Hoy Jr., U.S. Pat. No. 5,052,965 are either bulky, unwieldy, and unsuitable for compact storage or portability. Not all of these devices provide floatation in a semi-submerged configuration. Furthermore, few of them are designed to be collapsible and portable without being deflated (in the case of inflatable devices). All of them require the user to carry their other paraphernalia when going to the beach, pool or lake. None of these devices provide the combination of a multi-functional tote bag, semi-submergible floating chair/recliner and collapsible beach chair/pad. Others are disassembled with varying degrees of difficulty.

Vandenberg, U.S. Pat. No. 4,822,309 is a combined life preserver cushion and tote bag which provides no mechanism for converting the said invention into a collapsible beach chair, a back pack, or a variable sized multi-functional tote bag. It also lacks a fixed center section which provides for side panels which provides greater support to the torso and lumbar regions and, as mentioned previously, a baby change pad that provides privacy and wind protection to mothers when changing their infant in a private area.

For Vandenberg's invention to float an individual in a semi-submerged sitting position, the thickness of the foam would have to be reduced to less than $1\frac{1}{2}''$. If the thickness of the foam was reduced for this reason, Vandenberg's invention could no longer be classified as an aquatic safety device. In accordance with U.S. Coast Guard regulations, a personal throw able floatation device must be a minimum of $2\frac{1}{4}''$ thick and must be able to float the user atop the water. His invention also does not provide for a fixed torso sitting position for the user to sit in a semi-submerged floating position. Thus the user floats atop the water and as soon as an individual leans against the back cushion, he/she falls backwards because no supporting side portions have been provided for.

Since Vandenberg's invention cannot float an individual in a semi-submerged sitting position, it does not solve the problem that exists for boaters or pool owners who, on a hot sunny day, want to be able to float sitting semi-submerged in the water (not atop the water where it is hot) with back support and where they can stay cool and converse with their friends.

OBJECTS AND ADVANTAGES

This invention relates to a combined multi-functional tote bag, floating semi-submergible chair/recliner and collapsible beach chair/pad which as been designed to provide a quality product with as many uses as possible to the consumer at an economical price. More specifically, the object of this invention is the ability to provide an article with a substantial internal storage space for carrying various items with ease, which is not bulky and unwieldy, and which may be unfastened and converted into many configurations to meet the needs of the consumer.

An advantage of the combination multi-cushioned and zippered construction is the ability to enable the unit to be quickly and conveniently converted from a multi-functional tote bag to a number of uses that have never been incorporated in a combination tote bag invention in prior art. As a result, this invention is not seasonal, it can be utilized year-round, for recreational, domestic or business purposes.

Another object of this invention is the ability to provide a collapsible beach chair with comfortable and sturdy back support. This is achieved by providing a collapsible chair frame (which can be flatly stored in the bottom of the tote bag). The tote bag unzips to a flat position, the chair frame is assembled and the top of the frame is assembled and the top of the frame is placed into the pocket of the headrest cushion to secure the cushioned configuration to the frame. It is conceivable that a collapsible outdoor umbrella could be clipped to the chair frame to protect the individual from UV rays.

Another object of this invention is the ability to provide a recreational, non-inflatable floating device for adult use which permits the user to float in a fixed angle torso position, semi-submerged sitting position and provides torso and lumbar support by providing fixed side panels thus, providing a comfortable and secured sitting position.

An advantage of being able to float semi-submerged solves the problem for individuals who, on a hot sunny day for instance, when tired of swimming, want to stay cool by floating semi-submerged in a sitting position with back support and carry on a conversation with their friends while at the same time remaining comfortable and cool. The lack of such a device is clearly a problem for boaters. They are forced to hang on to the side of the swim platform, to float atop an aquatic safety device which doesn't keep them cool and increases the risk of sunburn, attach an aquatic device around the waist which requires the individual to continually rotate the feet in order to maintain an upright position, or to rely on inflatables that frequently puncture and have to be inflated and deflated with each use.

Another object of this invention is the ability to provide a recreational non-inflatable, semi-submergible floating device with a cushioned headrest which permits the user to float semi-submerged in a reclining position with the headrest floating atop the water to help prevent water from entering into the user's ears.

A further advantage of this invention is the ability to provide a recreational non-inflatable, semi-submergible floating device which, when two units are fastened together in a side by side configuration and resembles the appearance of a love seat, two individuals can float semi-submerged in a sitting position. Alternatively, when all of the side zippers are unfastened to form an elongated flat cushioned pad, and two such units are fastened together, the configuration enables two individuals to float in a reclined position side by side.

Another object of this invention is the ability to provide a cushioned flat surface that acts as a beach pad or chair pad cushion, An additional object of this invention is the ability to provide a tote bag which is light weight and can be carried by either hand straps, or a shoulder strap. An extension of the above abject is the ability to convert the carrying case into a back pack by removing the shoulder strap and attaching it to the three loops provided on the back cushion of the carrying case. This is an important function for mothers, cyclists, and hikers.

A further advantage of this invention is the ability to create a multi-functional tote bag of a size and shape that encourages it's use as carry-on luggage on an airplane or as an overnight bag.

An additional advantage of this invention is the ability to provide a multi-functional tote bag which can be turned inside out or rather that is reversible due to the fasteners on each section. This advantage enables an individual who has, for instance, gotten the fabric wet from lying on it to load their paraphernalia into the dry side of the multi-functional tote bag without concern of damage to the contents, e.g. camera, radios, etc.

Another advantage of being able to reverse the multi-functional tote bag is the ability to provide the individual with a broader scope of usage. For instance, it can be covered with a vibrant colored fabric on one side (for beach use) and with more conservative colored fabric on the other side (for business use or as carry-on luggage).

An additional object of this invention is the ability to provide a "briefcase" for transporting artwork, correspondence, magazines, etc. This is achieved by zipping the two outside cushions together.

A further advantage of the previously mentioned object is that, in this configuration, the unit can also be carried to sporting events where the cushions, when unfastened can be used as two sport seats.

A further advantage of this invention is the ability to create an insulated carrying bag. The buoyant cushioned sides act an insulating device for carrying beverages from one location to another and to protect the contents from damage.

It should also be noted that this product can be used for many purposes not cited in this document (kneeling pad, bed rest, car seat cushion, shopping bag, etc.). However, these uses become obvious with use and vary depending on the individual's needs and circumstances.

These and other objects, features and advantages of this invention will become apparent from a consideration of the drawings. To the accomplishment of the above and related objects, this invention may be embodied in the form illustrated in the accompanying drawings, attention being called to the fact, however, that the drawings are illustrative only, and that changes may be made in the specific construction and shape illustrated.

FIG. 10 is a perspective view of the headrest of a secondary embodiment.

FIG. 11 is a perspective view of the present invention of FIG. 1 in its chair-like position or baby change bag when placed upside down.

FIG. 12 is a perspective view of two of the present invention FIG. 1 zipped together as a connected pair of floating seats.

FIG. 13 is a perspective view of a secondary embodiment whereby a removable headrest could be attached to the front cushion.

REFERENCE NUMERALS

10 PRESENT INVENTION
12 FRONT SECTION
13 BACK SECTION
14 SIDE SECTION
16 ZIPPERED POCKET
17 MIDDLE SECTION
17A HINGE
18A POCKET ZIPPER FEMALE
18B POCKET ZIPPER MALE
19 SMALL LOOP
20 SHOULDER STRAP
20A SNAP FASTENING PORTION
20B RING FASTENING PORTION
21 LOOP SEWN TO TOP SEAM
22 HANDLE STRAPS
23A HANDLE SEWN TO FRONT
23B HANDLE SEWN TO BACK
24 LARGE LOOP
25 BOTTOM MATERIAL SEAM
26 BOTTOM MATERIAL SEAM
28 SLIDE FASTENER
30A MALE HALF ZIPPER FASTENING MEANS
30B FEMALE HALF ZIPPER FASTENING MEANS
31A MALE HALF ZIPPER FASTENING MEANS
31B FEMALE HALF ZIPPER FASTENING MEANS
33 ELONGATED CENTER SECTION
40 HEADREST
42 POCKET OF HEADREST
43 FLEXIBLE HINGE
44 FLAP
45 REAR LAYER
48 EDGE OF POCKET
49 TOP OF HEADREST
50 SEAMS OF HEADREST
51 SEAMS OF HEADREST
53 BUOYANT MATERIAL
54 DURABLE MATERIAL CASING
58 COLLAPSIBLE CHAIR FRAME
60 POSTERIOR SIDE
62 BOTTOM SEAM
63 LAYER OF MATERIAL
64 SIDE SEAMS
66 SIDE SEAMS
68 TOP SEAM
70 LAYER OF MATERIAL
72 TOP SEAM
74 SIDE SEAM
76 SIDE SEAM
77 BOTTOM SEAM
78 PAIR OF L-SHAPED TUBULAR MEMBERS
79 REMOVABLE TOP MEMBER
80 REMOVABLE BASE MEMBER
82 TOP OF TUBULAR MEMBERS
84 TOP OF TUBULAR MEMBERS
86 BOTTOM OF TUBULAR MEMBERS
88 BOTTOM OF TUBULAR MEMBERS
90 DISTAL ENDS CRIMPED
92 DISTAL ENDS CRIMPED
94 TOP ZIPPER
96 POSTERIOR SIDE OF HEADREST

DESCRIPTION OF THE PREFERRED EMBODIMENT

Figure 1:
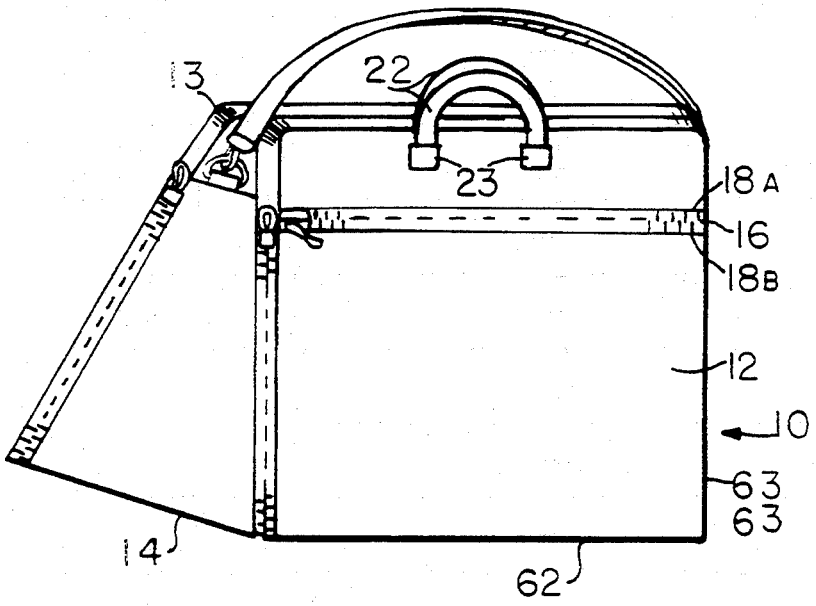
FIG. 1 is a perspective view of the invention in its tote bag configuration.

Referring to the drawings, FIG. 1 shows the preferred embodiment of the combined I tote bag/semi-submergible floating chair and chair pad generally designated by number 10. In this preferred embodiment, the multi-functional carrying assembly/semi-submergagle floating chair and chair frame/pad is comprised of a back section 13, a left and a right side section 14, a middle section 17, a front section 12 and a headrest cushion 40. Each of the sections 12, 14, 17, and 13 are preferably comprised of a buoyant material 53 of a preferred thickness of 1" planar polyethylene foam or any similar type of material suitable for the purpose, and section 40 is preferably comprised of 2" thick buoyant material 53. Each of the sections 12, 14, 17, 13 and 40 are encased in a durable material 54 preferably made from such fabric as cotton, polyester, or a combination thereof or other suitable coverings which allow the water to drain easily from the cushions and which also dries quickly (see FIG. 5). Back section 12 and front section 13 are generally rectangular in shape and are approximately 18" wide by 16" long, side sections 14 are generally irregular rectangular in shape and are approximately 12" long, middle section 17 is approximately 18" wide and 8" long and rectangular in shape. Headrest 40 is generally rectangular in shape and is approximately 16" wide and 7.5" long.

Figure 3:
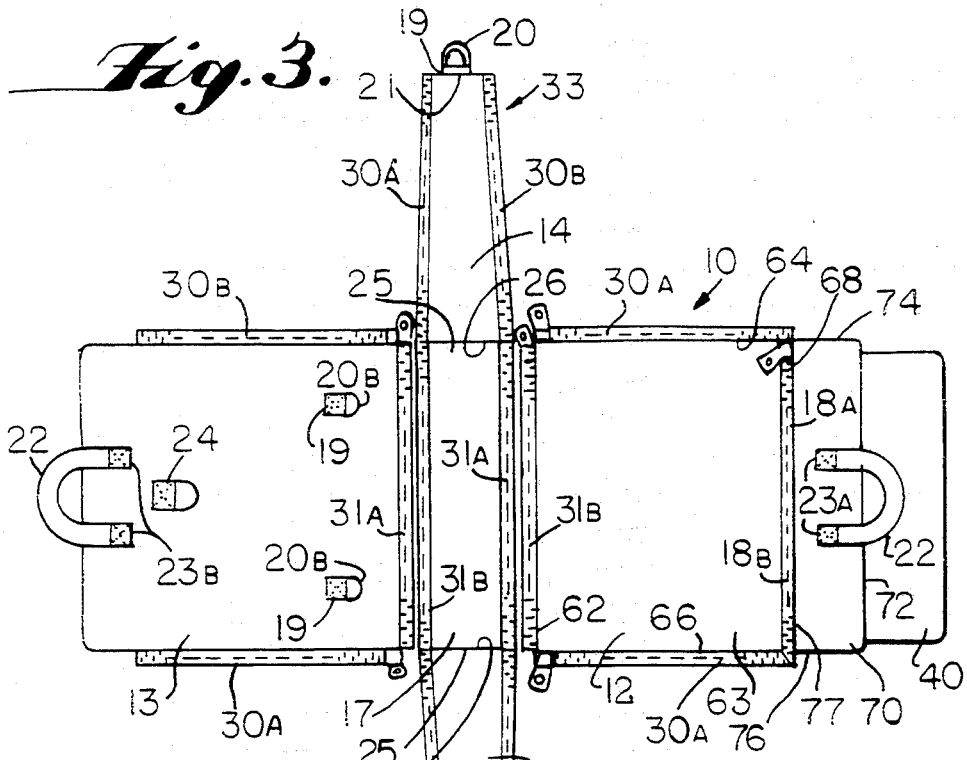
FIG. 3 is a top view of the outside of the present invention FIG. 1 in a separated laid-out configuration.

Referring to FIG. 1, 3, and 10 which show various perspectives of headrest 40, in order to give headrest 40 the capability to fold into the storage area of the bag, there is provided an outer hinge 43 made of material 54 which is connected between headrest 40 and a posterior side 60 of front section 12. A flap 44 extends across a rear layer 45, flap 44 being secured on headrest 40 at a top 49 and along the adjacent portions of a seam 50 and a seam 51. Flap 44 is rectangular in shape and secured on three of its four edges to form a pocket 42 on an edge 48 opposite top 49 being open.

Referring to FIG. 3 the anterior side of front section 12 has a handle strap 22 preferably flexible, located close to the top of section 12 which is proportionally centered. Strap 22 is attached at a distal end 23A by fastening each end 23A to material 54 (see FIG. 4). A zippered pocket 16 is affixed to present invention 10 by sewing an additional layer of material 63 equivalent to two thirds of the size of section 12 to the bottom of a seam 62 and is then secured along the adjacent portions of a seam 64 and a seam 66. A top seam 68 has a preferred female zipper portion fastening means 18A attached thereto. An additional layer of material 70 equivalent to one third of the size of section 12 is affixed to a top seam 72 and secured along the adjacent portions of a seam 74 and a seam 76. A bottom seam 77 has a male zipper portion fastening means 18B sewn thereto. When zippers 18A and 18B are zipped together, it creates a sealed pocket 16 to protect items from falling out of tote bag 10. The left peripheral edge of section 12 has a male half zipper fastening means 30A sewn thereto. The right peripheral edge of section 12 has a female half zipper fastening means 30B sewn thereto. The bottom peripheral edge of section 12 has a female half zipper fastening means 31 B sewn thereto.

Side sections 14 are attached to middle section 17 preferably by stitching a bottom material seam 25 of each side section 14 to a bottom seam 26 of middle section 17 to form a hinge 17*a* which join to sections 14 and 17 to create an elongated center section 33 (see FIG. 3). On the generally vertical edges of side sections 14, matching zipper halves 30A and 30B are attached thereto. On the peripheral edges of section 17 a pair of matching zipper fastening means 31A and 31B are sewn thereto. A small loop 19 is looped through a ring portion of fastening means 20B. Each distal end of loop 19 is sewn into a top seam 21 of section 14. One distal end of a flexible shoulder strap 20 is threaded through the center portion of a slide fastener 28 and is sewn to strap 20 thereby allowing the shoulder strap to be adjustable in length, The other distal end of strap 20 is threaded through a snap fastener means 20A which can be movably affixed to the shoulder strap assembly. This distal end is then threaded through another fastener means 20A, folded and sewn to strap 20 thereby permanently affixing fastener 20A to shoulder strap 20. Each fastener 20A can then be attached to ring fastener 20B. The peripheral edges of center section 17 have matching zipper halves 31A and 31B attached thereto.

On the anterior side of back section 13, shown in FIG. 3, handle strap 22 is attached close to the top of section 13 which is proportionally centered. Strap 22 is attached at a distal end 23B by sewing each end 23B to material casing 54. A large loop 24 is sewn to the material 53 (see FIG. 4) one third of the distance down section 13 and proportionally centered. Small loop 19 is passed through ring fastener device 20B and sewn close to the lower left and right corners of section 13 thereby allowing shoulder strap 20 to be attached thereto. The left peripheral edge of section 13 has male zipper half 30A sewn thereto. The right peripheral edge of section 13 has female zipper half 30B sewn thereto. The bottom peripheral edge of section 13 has male zipper half 31A attached thereto.

Figure 2:
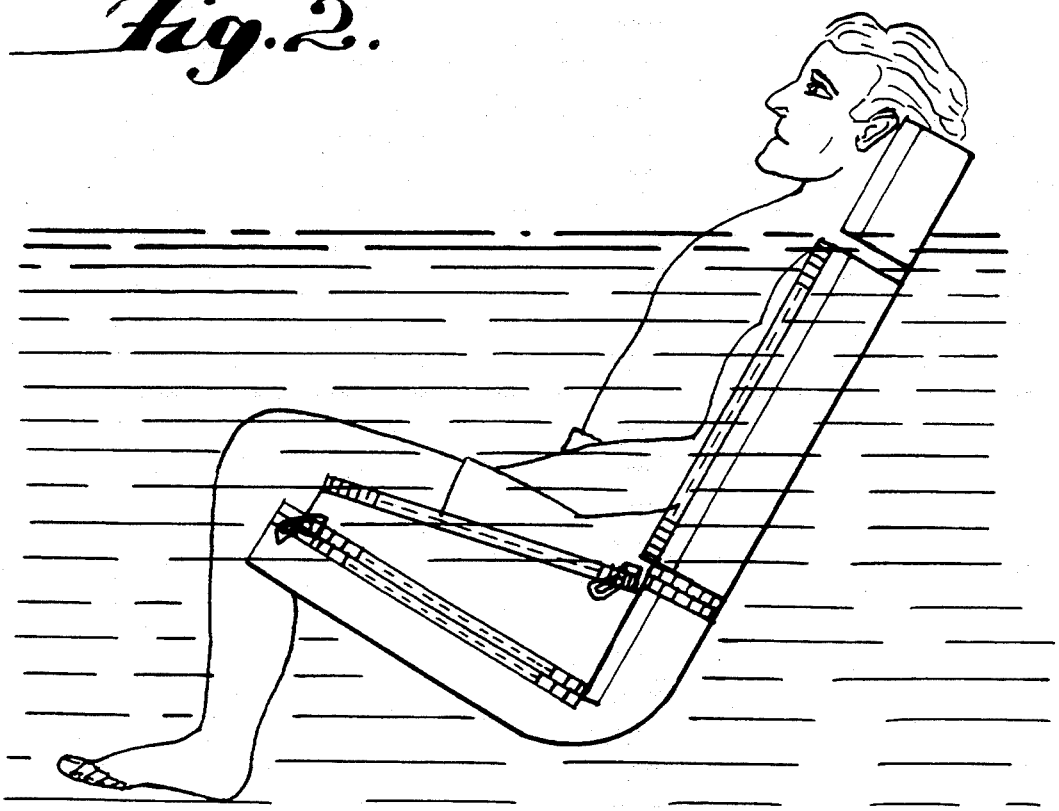
FIG. 2 shows the present invention of FIG. 1 positioned in the chair configuration and showing a person floating thereon in a semi-submerged position in a body of water.

Referring to drawing, FIG. 2 and FIG. 11, invention 10 is shown in a semi-submergible floating chair configuration with a person lying in the water thereon and out of the water in the chair configuration. To configure invention 10 into this position, the user would undo peripheral side zippers 30A and 30B which attach front section 12 to elongated center section 33. Thus side zippers 30A and 30B which attach back section 13 to elongated center section 33 remain zipped up.

Figure 4:
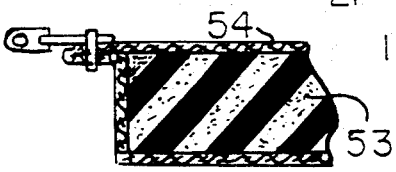
FIG. 4 is a cross-sectional view taken along line 4—4 in FIG. 3.

As shown in FIG. 4, the cross-sectional view of present invention 10 shows buoyant material 53 which is comprised of an inner core preferably made of uni-cellular high density cross link polyethylene foam slabs with an outer covering of a type of durable material 54.

Figure 5:
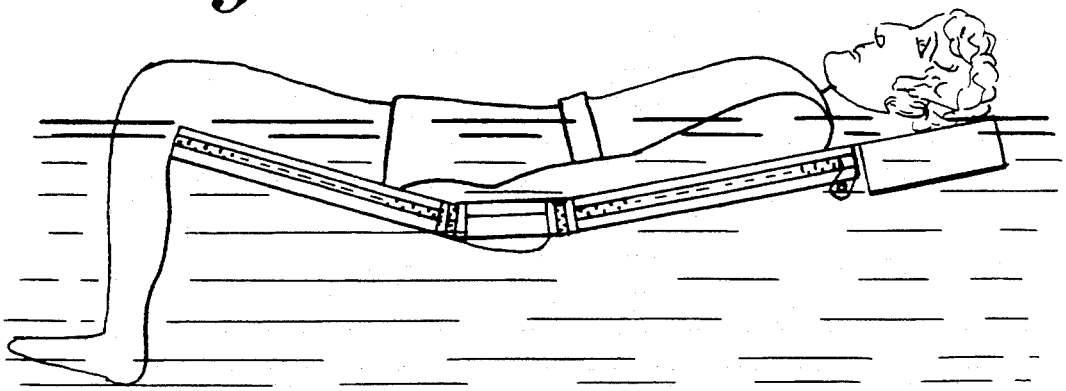
FIG. 5 shows the floating chair of the present invention of FIG. 1 reclined in a horizontal position and showing a person thereon in a body of water.

A perspective view of present invention 10 is shown in FIG. 5 where present invention 10 is configured to form a floating recliner by the user merely grasping each of the zipper pulls affixed to zippers 30A and 30B, which are affixed to the back section 13 and center section 33 and pulls on these zipper pulls to undo zippers 30A and 30B. The user would then unzip zippers 30A and 30B, which are affixed to front section 12 and center section 33, and pulls on these zipper pulls to undo zippers 30A and 30B.

Figure 6:
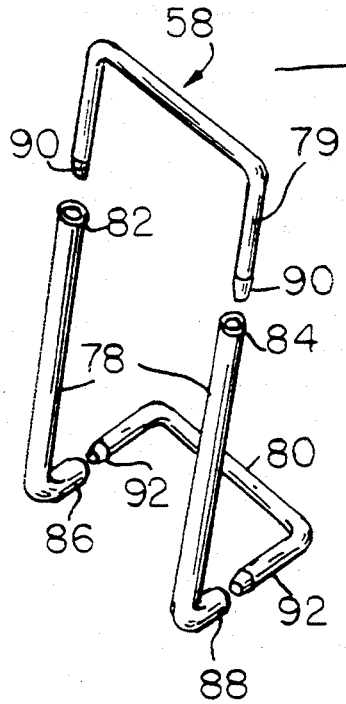
FIG. 6 is an exploded view of preferred embodiment of the chair frame.
Figure 7:
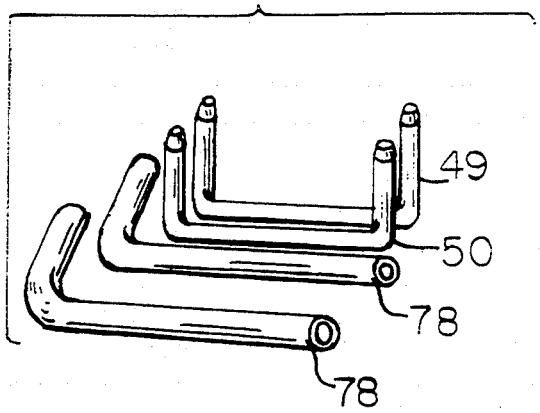
FIG. 7 is an isometric view of the chair frame collapsed for storage.
Figure 8:
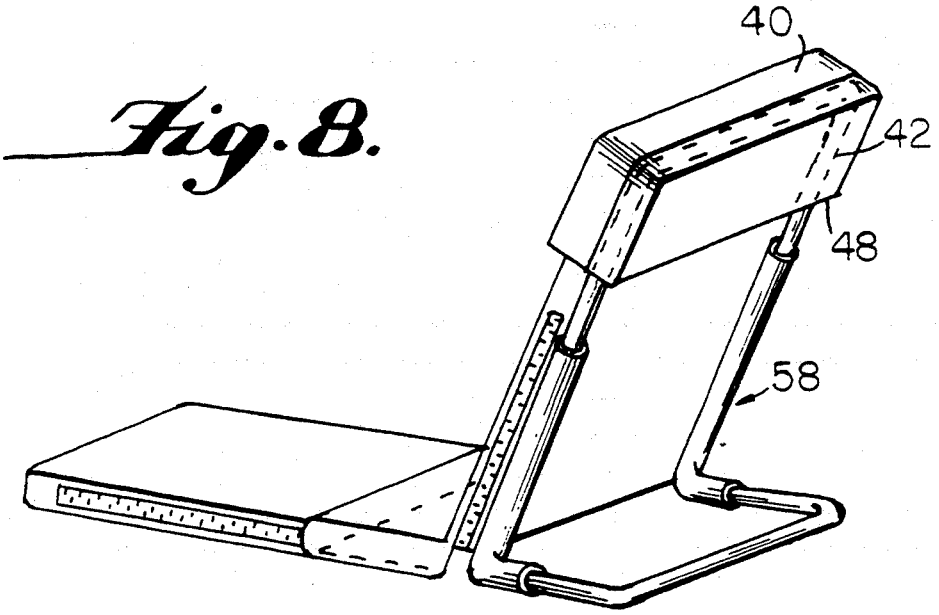
FIG. 8 is a perspective view of a preferred embodiment of a collapsible chair frame with the multi-functional tote/chair pad attached thereto.

Referring to drawings FIG. 6, FIG. 7, and FIG. 8, show views of a beach chair frame generally designated by number 58. Frame 58 consists of a plurality of L-shaped tubular members 78, a tubular top member 79 and a tubular base member 80. Each member 78, 79, and 80 is preferably made from a rust resistant metal such as aluminum, plastic or any similar suitable material which is powder coated and is strong enough to withstand the weight of the average person. Each tubular member 78, 79, and 80, have a circumference of 1" so that it is easily stored within the tote. Tubular members 78 are not crimped at an end 82, 84, 86, and 88 and is approximately 18" long and the bent section is approximately 6" long. Tubular top member 79 is U-shaped and is approximately 15.5" wide and 9" long and has a crimped end 90 located on each distal end so that it may be placed into and removed from the bottom of each tubular members 78. Tubular base member 80 is U-shaped and is approximately 15.5" wide and 7" long and has a crimped end 92 located at each distal end so that it may be placed into and removed from the bottom of each tubular members 78. When each of the members 78, 79, and 80 are attached together to form chair frame 58, frame 58 is then placed into pocket 42 on headrest 40.

Figure 9:
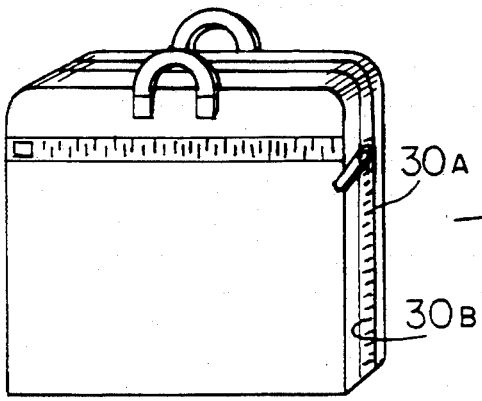
FIG. 9 is a perspective view of present invention of FIG. 1 configured as a briefcase.

A perspective view of present invention 10 is shown in FIG. 9, whereby a briefcase is formed. The briefcase configuration consists of front section 12 and back section 13 which are attached together by zipping fasteners 30A and 30B together and zippers 31A and 31B together to create a narrower tote bag to be used as a briefcase or for small documents.

A perspective view of present invention 10 is shown in FIG. 12 whereby two of present invention 10 are zipped together as a connected pair of semi-submergible floating seats. To configure invention 10 into this position the user would use two of present invention 10 and undo the peripheral side zippers 30A and 30B which attach front section 12 to elongated center section 33 and zippers 30A and 30B which attach back section 13 to center section 33. Side zippers 30A and 30B, of each back section 13 are zipped together on one side of each invention 10. Matching zippers 30A on one section 13 and zipper 30B on each front section 12 are then zipped together to create a semi-submergible floating pair of seats. Obviously, any multiple arrangements are possible.

As shown in FIG. 13, a secondary embodiment is conceivable whereby the posterior side of front section 12 may have a zipper 94 of sufficient length attached to the peripheral top of section 12. Headrest 40 could be removably affixed to front section 12 whereby a zipper could be placed on a posterior side 96 of hinge 43 thus allowing headrest 40 to be attached to or removed from section 12. It is also conceivable that hook and loop fastener may be used also.

OPERATION OF INVENTION

In operation, the Combined Tote Bag, Semi-submergible Floating Chair/Recliner and Beach Chair/Pad 10, FIG. 3, can be converted into a multi-functional tote bag 10 FIG. 1 by zipping fasteners 31A and 31B together whereby front section 12 and back section 13 are adjoined to the elongated center section 33. Zipper fasteners 30A and 30B are then zipped together. The user would then place all of their desired paraphernalia into tote 10. Headrest 40 is then folded into the compartment section of the multi-functional tote bag 10 and the user can place articles, which they may need to be readily available, into the headrest pocket 42. To affix shoulder strap 20 to the multi-functional tote bag 10, the user would snap each clip fastener 20A to each ring fastener 20B and place strap 20 over the desired shoulder.

To utilize the back pack FIG. 3, a user would clip one fastener 20A located on the end of shoulder strap 20 to fastener 19 located on back section 13. The user would then grasp the opposite end of strap 20, thread it through large loop 24 and clip snap fastener 20A to ring fastener 20B thus creating two carry straps which are to be slid onto the user's shoulders to enable them to use the back pack and have both hands free to use. To adjust the length of the shoulder strap for either use, the user merely pulls on slider 29 to shorten or lengthen strap 20 for desired comfort. To utilize carrying handles 22, the user merely places their hand through both handles 23A and 23B, grasps the handles and lifts tote 10. Zippered pocket 16, which is located on the anterior side of front section 12 may be opened and closed easily by zipping and unzipping zipper portions 18A and 18B. This pocket is large enough to insert magazines, newspapers or other paraphernalia into it by undoing zipper portions 18A and 18B, opening the pocket and placing the desired item(s) into it.

To create the semi-submergible floating chair FIG. 2 and FIG. 11 from the multi-purpose multi-functional tote bag 10, FIG. 1, a user would undo peripheral side zippers 30A and 30B which attach front section 12 to elongated center section 33. Thus, side zippers 30A and 30B, which attach back section 13 to elongated center section 33, remain zipped up. The user then places the semi-submergible floating chair into the water, pulls it under their thighs and buttox and places their back against the posterior of front section 12. Headrest 40 naturally provides headrest support as the user leans his/her head against it. Since back section 13 is affixed to elongated center section 33 a fixed angle is created between section 13 and section 33 thus providing a fixed hip and torso position for the user, whereby the semi-submergible floating chair provides the user with torso and lumbar support and a stable sitting position. This enables the user to float with support and comfort while in a sitting position due to the structural integrity of the design.

This same configuration, FIG. 11, may be used to create a baby change pad placing front section 12 and section 33 on a flat surface and having back section 13 in a vertical position. Section 12 provides a sufficiently long enough padded area on which to place the infant for changing. Side sections 14 and back section 13 create a form of a privacy shield combined with a wind shield to protect the baby while it is being changed. Thus invention 10 provides a mother with a baby change pad which provides for a wind shield to protect the child, and a privacy screen so that the mother may change the child in a more private manner.

To recline the chair to a fully horizontal position FIG. 5, while floating in the semi-submerged sitting position, the user merely grasps each of the zipper pulls affixed to zippers 30A and 30B, which are affixed to back section 13, and center section 33 and pulls on these zippers pulls to undo zippers 30A and 30B. Since the user no longer is sitting in a fixed torso position, he/she merely leans back against front section 12 until they are in a fully horizontal position.

If the user is configuring multi-functional tote bag 10 into the floating recliner the user would remove shoulder strap 20 by releasing snap fasteners 20A from ring fasteners 20B, remove all articles from multi-functional tote bag 10, headrest pocket 42 and zippered pocket 16 and undo all male and female zipper portions 30A and 30B. The user would then place the device in the water, pull back section 13 under their buttox and thighs, and lean his/her back against front section 12 until they are in a fully reclined position whereby their head is firmly placed on headrest 40 and the user is in a comfortable, reclined position. This same configuration can be used out of the water as a patio chair pad, a lounge insert, or a pad for laying on.

To create a semi-submergible floating chair for two FIG. 12, a user would use two multi-functional tote bags 10 and undo the peripheral side zippers 30A and 30B which attach front section 12 to elongated center section 33. They would then undo one set of zippers 30A and 30B, which attach to back section 13, on each multi-functional tote bag 10. Thus, one set of side zippers 30A and 30B which attach back section 13 to elongated center section 33 would remain zipped Up. The user would zip female zipper portion 30A, located on one back section 13, to male zipper portion 30B on other multi-functional tote bag 10 back section 13 thereby attaching two back sections 13 together. The user would then zip female zipper portion 30A, located on one front section 12, to male zipper portion 30B on other multi-functional tote bag 10 front section 12 thereby attaching the two front sections 12 together. Thus, by attaching both multi-functional tote bags 10s together, a semi-submergible floating seat for two people is created. This same method may be used for attaching more than two of multi-functional tote bags 10 together. The users would then place themselves on the floating chairs as previously described.

To create the collapsible beach chair, FIG. 8, from multi-functional tote bag 10 configuration, the user would remove all items from multi-functional tote bag 10 including tubular members 78, 79 and 80. The user would then place the top section 82 of tubular member 78 over crimped end 90 of tubular member 79 and place bottom section 86 into a tubular side portion 92 of tubular member 80. The user would then place top section 84 of tubular member 78 over crimped end 90 of tubular member 79 and place bottom section 88 into a tubular side portion 92 of tubular member 80 and place on the ground or floor. The user would then undo all zippers 30A and 30B of present invention 10 and place pocket 42 over tubular member 79. The user then merely sits upon the pad, leans back and relaxes in comfort.

As shown in FIG. 9, present invention 10 may also be configured to create a briefcase or a small tote bag. To accomplish this, the user would remove the elongated center portion 33 from section 12 and 13 by unzipping fasteners 30A, 30B, 31A, and 31B. The user would then zip fasteners 30A, 30B, 31A and 31B together located only on section 12 and section 13 thereby attaching sections 12 and 13 directly together and creating a small tote bag or briefcase within which the user would then place all of his/her necessary articles.

CONCLUSIONS, RAMIFICATIONS AND SCOPE

Accordingly, the reader will see that the combined multi-functional tote bag/semi-submergible floating chair/recliner and chair frame/pad can be used as both a tote bag, a briefcase, a back pack, a floating chair, a floating recliner, a baby change pad, a beach chair with a collapsible frame, and a lounge chair pad. In addition, it is light-weight, portable, relatively inexpensive to manufacture, non-puncturing, reversible and can be used year round as a utility bag. Furthermore, the floating chair and utility bag has the additional advantages in that:

- it provides the user with a fixed torso sitting position when in the chair configuration which provides the user with a stable and supported torso and lumbar position thereby creating a comfortable and supportive sitting position while floating in the water
- it allows the user to carry many items securely
- it allows the user three different ways to carry the invention (by the hand straps, shoulder strap, or back-pack strap)
- it provides for the shoulder strap to be used to create a back-pack strap
- it can easily be converted into a briefcase
- it provides the user with a chair frame so that they can configure the invention into a beach chair
- it provides the user with a chair pad for most types of chairs or patio furniture
- it provides the user with a baby change bag with a privacy and wind shield
- it has the insulating qualities of a beverage cooler and the protective padding of a camera case
- it allows two or more of the inventions to be zipped together to provide a semi-submergible floating seat for two or more people
- it provides a headrest which prevents the user's ears from getting wet while in the horizontal floating position
- the cushions may be separated add used in many different configurations
- most of these functions are available through the use and ownership of only one of the described invention.

Although the description above contains many specificities, these should not be construed as limiting the scope of the invention, but as merely providing illustrations of some of the presently preferred embodiments of this invention. For example, the preferred embodiment utilizes zippers but, hook and loop fasteners may be substituted; rather than utilizing ring and fasteners, buckles or clips might be used; the outer material could be canvas, nylon, leather or any type of fabric which is durable. The back section could be substituted without the back pack loops and fasteners attached to it. The shoulder strap and/or the handles could also be removed without necessarily changing the scope of this invention as long as there is at least one type of strap or handles attached to this invention. The chair frame could fold together with hinges rather than all of the pieces being removed from each other. The headrest could be removably attached by providing a zipper or other type of fastening device to the headrest and to the front or back cushions to provide a headrest which can be attached to or removed from the tote bag. It is also conceivable that the side sections which are sewn to the middle section to create the elongated center section in the preferred embodiment could be removably attached to the middle section through the use of a fastening devices such as zippers or velcro without departing from the intent of this invention.

The foregoing detailed description is to be clearly understood as given by way of illustration and example only, the spirit and scope of this invention being limited solely by the appended claims.

What is claimed is:

1. A multi-purpose tote bag convertible to a semi-submergible floating chair and convertible to a beach chair comprising:

at least five planar sections having anterior and posterior sides comprised of a buoyant material and encompassed by a material casing; said planar sections including a front section having a pair of opposing longitudinal edges and a bottom edge, a back section having a pair of opposing longitudinal edges and a bottom edge, and an elongated center section, said center section including a middle section having a pair of opposing first and second longitudinal edges and a pair of opposing end edges and a pair of side sections hingeably affixed to opposing said end edges of said middle section, each said side section having a pair of opposing longitudinal edges;

fastening means associated with each of the planar sections, said fastening means being constructed and arranged such that fastening means disposed on the bottom edge of said front section are fastenable to fastening means disposed on the first longitudinal edge of said center section, fastening means disposed on the bottom edge of said back section are fastenable to fastening means disposed on the second longitudinal edge of said center section, fastening means disposed on each longitudinal edge of said front section are fastenable to each matching longitudinal edge of said side sections, fastening means disposed on each longitudinal edge of said back section are fastenable to each remaining longitudinal edge of said side sections so as to define an open area between said front section, said side sections and said back section to provide a large storing area;

said front section, said elongated center section and said back section having a combined density and thickness sufficient to float an average size adult semi-submerged in a sitting position;

said front section being generally rectangular in shape having a length sufficient to accommodate the length of the average adult's thigh and a width sufficient to accommodate the width of the average adult's buttox;

said elongated center section being generally rectangular in shape and equal in width to the width of said front section; a length of said elongated center section being of sufficient size when combined with the length of said back section to support the back height of the average adult;

said side sections being generally rectangular in shape and equal in length to the length of said elongated center section; the height thereof being no greater than the length of said front section or said back section; the bottom of each said side section is hingeably affixed to each end edge of said elongated center section; and a headrest cushion attached to said front section, said headrest cushion having sufficient thickness and density to float an average size adult's head above water, said headrest cushion being generally rectangular in shape and hingably attached to said front section whereby said headrest cushion can be folded inwardly or outwardly, said headrest cushion being of sufficient dimension to permit said headrest cushion to be easily folded into or out of the multi-purpose tote bag.

2. The invention as recited in claim 1, further comprising a collapsible chair frame comprising a plurality of L shaped tubular members, a top tubular member, and a bottom tubular member, said collapsible chair frame being formed from material such that said collapsible chair frame can support the weight of an average person, said top tubular member and said bottom tubular member being adapted to be placed onto said L shaped tubular members to form a ridged frame; each distal end of said top tubular member being adapted to be placed onto a top end of an associated L shaped tubular member, each distal end of said bottom tubular member being adapted to be placed onto a bottom end of each said L shaped tubular member; said top tubular member, said L shaped tubular members and said bottom tubular member having a combined length when placed together, equivalent to a length of said headrest cushion, said front section and said center section when attached together and having a width equivalent to the width of said front section, said headrest cushion having a pocket attached to an anterior side, said top tubular member being of sufficient circumference to be securely placed into said pocket or removed from said pocket.

3. The invention as claimed in claim 1, wherein said fastening means comprises a zipper.

4. The invention as claimed in claim 1, wherein said tote bag is constructed and arranged for carrying a substantial number of articles after attaching said fastening means disposed on bottom edge of said front section to said fastening means disposed on one longitudinal edge of said center section then attaching said fastening means disposed on the bottom edge of said back section to said fastening means disposed on the remaining longitudinal edge of said center section, then attaching said fastening means disposed on each longitudinal edge of said front section to each matching longitudinal edge of said side sections, attaching each longitudinal edge of said back section to each remaining longitudinal edge of said side section to define said open area; said multi-purpose tote bag further including at least one strap for carrying said tote bag.

5. The invention claimed in claim 1, wherein said tote bag is constructed and arranged such that a non-inflatable semi-submergible floating chair is formed by attaching said fastening means disposed on the bottom edge of said front section to said fastening means disposed on one longitudinal edge of said center section then attaching said fastening means disposed on the bottom edge of said back section to said fastening means disposed on the remaining longitudinal edge of said center section, then attaching said fastening means disposed on each longitudinal edge of said front section to each fastening means disposed on each matching longitudinal edge of said side sections whereby a standard fixed angle is defined between said back section and said middle section whereby a sitting area is formed.

6. The invention claimed in claim 5, wherein said fixed angle defines a fixed torso sitting position between said back section and said middle section which provides stability, and torso and lumbar support to the user while floating in the water.

7. The invention claimed in claim 1, wherein said tote bag is constructed and arranged such that a semi-submergible floating recliner is formed by attaching said fastening means disposed on bottom edge of said front section to said fastening means disposed on one longitudinal edge of said center section then attaching said fastening means disposed on the bottom edge of said back section to said fastening means disposed one the remaining longitudinal edge of said center section, for supporting a user when placed in a horizontal position in water.

8. The invention claimed in claim 1, wherein said tote bag is constructed and arranged such that a smaller tote bag for carrying flat items is formed by attaching all of the fastening means of said front section to each of the fastening means on said back section.

9. The invention as claimed in claim 2, wherein said tote bag is constructed and arranged such that said beach chair is formed by attaching said fastening means disposed on bottom edge of said front section to said fastening means disposed on one longitudinal edge of said center section then attaching said fastening means disposed on bottom edge of said back section to said fastening means disposed on a the remaining longitudinal edge of said center section, then placing said top tubular member into said pocket on said headrest cushion, then placing each of said L shaped tubular members into each distal end of said top tubular member, placing each distal end of said bottom tubular member over each remaining end of said L shaped tubular members.

10. The invention as claimed in claim 1, wherein said front section and said back section include a carrying means including a plurality of handle straps, said handle straps including a set of spaced apart straps secured close to a top of said front section and said back section on an anterior side and are placed an equal distance apart.

11. The invention as recited in claim 1, wherein said elongated center section has a ring fastening means centrally affixed to a top edge seam of said side sections.

12. The invention as recited in claim 11, in combination with a detachable shoulder strap having a strap of sufficient length to accommodate people of various sizes; said strap having snap fastener means located on each distal end whereby said strap can be attached to or removed from said ring fastening means.

13. The invention as recited in claim 12, whereby said back section has means for attaching said shoulder strap thereto to define a back pack carrying means.

14. The invention as claimed in claim 13, wherein said back pack carrying means comprises a large loop, a pair of small loops and a pair of ring fasteners; said large loop being of sufficient size to enable said shoulder strap to be threaded therethrough; said large loop being located approximately one third of a distance from a top of the anterior side of said back section and centrally located on the side thereof; said small loops being threaded through said ring fasteners and affixed to said back section; said small loops and said ring fasteners being located close to bottom corners of said back cushion and placed an equal distance apart, said back pack being configured by clipping a snap fastener located on one distal end of said shoulder strap to said ring fastener, threading said shoulder strap through said large loop and clipping the other said snap fastener to the remaining said ring fastener.

* * * * *